United States Patent [19]

Storandt

[11] 4,298,213

[45] Nov. 3, 1981

[54] SKI SAFETY BINDING OF THE DIAGONAL RELEASE TYPE

[75] Inventor: Ralf Storandt, Leonberg, Fed. Rep. of Germany

[73] Assignee: Vereinigte Baubeschlagfabriken Gretsch & Co. GmbH, Leonberg, Fed. Rep. of Germany

[21] Appl. No.: 2,455

[22] Filed: Jan. 10, 1979

[30] Foreign Application Priority Data

Jan. 23, 1978 [DE] Fed. Rep. of Germany ..... 2802775
Aug. 16, 1978 [DE] Fed. Rep. of Germany ..... 2835732

[51] Int. Cl.[3] ..... A63C 9/085
[52] U.S. Cl. ..... 280/628; 280/629
[58] Field of Search ..... 280/626, 628, 629, 630, 280/631

[56] References Cited

U.S. PATENT DOCUMENTS 3,866,929 8/1973 Lacroix ..... 280/626
3,909,030 9/1975 Bevl ..... 280/630
3,915,467 10/1975 Frechin ....., 280/630
3,998,475 12/1976 Eckart ..... 280/628 X

FOREIGN PATENT DOCUMENTS 2161881 9/1972 Fed. Rep. of Germany .
2165314 7/1973 Fed. Rep. of Germany .
2341990 3/1974 Fed. Rep. of Germany .
2364298 6/1975 Fed. Rep. of Germany .
2418875 9/1975 Fed. Rep. of Germany .
2448769 4/1976 Fed. Rep. of Germany .
2627305 12/1976 Fed. Rep. of Germany .
2714125 10/1977 Fed. Rep. of Germany .

*Primary Examiner*—Robert J. Spar
*Assistant Examiner*—Fred A. Silverberg

[57] ABSTRACT

A safety binding for a ski comprising a housing pivotally mounted about a transverse axis, a sole clamp carried by the housing, an upward release mechanism incorporating an adjustable upward release spring and operative to locate the housing and the sole clamp in a closed position while adapted to release housing and sole clamp for upward pivotal movement about said transverse axis once the release setting of said upward release spring is exceeded. The binding also has a sideways release mechanism incorporating an adjustable sideways release spring one end of which bears against the housing. The sideways release mechanism is operative to locate the sole clamp sideways while adapted to allow the sole clamp to be displaced sideways to either side of the housing once the release setting of the sideways release spring is exceeded. The upward and sideways release springs are coil springs of different diameters and are located one within the other. Various embodiments are shown in which the coil springs are either tension or compression springs and are independently or jointly adjustable as desired.

39 Claims, 17 Drawing Figures

H
S
IV
II
III

SKI SAFETY BINDING OF THE DIAGONAL RELEASE TYPE

BACKGROUND OF THE INVENTION

The present invention relates to a safety binding for a ski and has particular reference to a safety binding of the kind in which a sole clamp is carried on a housing which is pivotally mounted about a transverse axis, and in which the sole clamp can pivot upwardly with the housing about the transverse axis, to release a ski boot upwardly, and can be displaced sideways relative to the housing, to release a ski boot to either side of the binding. Both the sideways and upward release mechanisms include adjustable springs which enable the sole clamp to be located in its normal clamping position while also being adapted release either upwards or sideways when the release settings of the respective springs are exceeded.

Ski bindings of this kind are generally known as diagonal release safety bindings because not only is sideways and upward release possible but also diagonal releases when the binding simultaneously releases both sideways and upwardly.

One known type of safety binding with upward and sideways release is disclosed in German specification DT-OS 2 448 769 in which a single spring is used both for the upward and for the sideways release. This arrangement allows a spatially compact system to be achieved but it means that any external influences must affect both the sideways and upwards release mechanisms. During a sideways release the release setting for the upward release must simultaneously change and vice versa or, the release mechanism for the other release device will exhibit unnecessary play.

For these reasons it is also known, from German specification DT-OS 2 364 298 to provide two independent release mechanisms for the upwards and sideways release which are provided with independently operating upward and sideways release springs. However, for this known safety binding the constructional and spatial demands are relatively large, and accordingly expensive and troublesome and the common adjustment of the release settings of the two springs is not possible.

The prime object of the present invention is thus to provide a safety ski binding of the diagonal release type which, despite the use of two independent release springs for sideways and upwards release, can be compactly constructed and which is suitable for manufacture by mass production means. The efficiency and reliability of release should not in any way be disadvantageously affected by the constructional measures taken to ensure compactness.

SUMMARY OF THE INVENTION

According to the present invention there is provided a safety binding for a ski comprising a housing pivotally mounted about a transverse axis, a sole clamp carried by the housing, an upward release mechanism incorporating an adjustable upward release spring and operative to locate the housing and the sole clamp in a closed position but to release housing and sole clamp for upward pivotal movement about said transverse axis once the release setting of said upward release spring is exceeded, there being further provided a sideways release mechanism incorporating an adjustable sideways release spring one end of which bears against the housing, said sideways release mechanism being operative to locate the sole clamp sideways but to allow the sole clamp to be displaced sideways to either side of the housing once the release setting of the sideways release spring is exceeded and wherein said upward and sideways release springs are coil springs of different diameters and are located one within the other.

In this way the space within one of the springs is used to accommodate the other spring so that no additional constructional space is necessary for housing the inner spring. The springs are generally coil springs with cylindrical surfaces and can be constructed both as tension and compression springs as desired.

Preferably the two release springs are arranged coaxially with one another as this allows the greatest saving of space to be achieved.

In one embodiment at least the sideways release spring is a tension spring and is located within the upward release spring. This embodiment is useful as the sideways release mechanism generally lies closer to the sole clamp and ski boot than the upward release mechanism so that the compactness of the construction is favourably improved and the complexity of the construction and the associated cost and difficulties are reduced.

In an alternative arrangement the sideways release spring is a compression spring and is associated with the sideways release mechanism via a rod located within the compression spring and loaded in tension and the upward release spring is located within the sideways release spring. In this arrangement the rod is connected to the end of the spring not contacting the housing via a spring abutment whilst the other end of the rod transmits the compression in the spring as a tensile force to the sideways release mechanism at which it is reacted. This alternative embodiment is also characterized by a minimal constructional requirement and an optimal utilization of the space available.

The constructions that are possible in accordance with the present invention are, however, particularly characterized in that either of the outer or inner springs can be associated with either the sideways or upward release mechanisms as desired and that any of these variants entail only a relatively small amount of constructional effort and expense.

In a preferred arrangement the upward release spring is also a compression spring with a tube located therein, the rod associated with the sideways release mechanism being axially displaceably located within the tube. The free end of the compression spring, i.e. the end that is not braced against the housing, is connected via a spring abutment to one end of the tube in order to transmit the compression in the spring as a tensile force via the tube. The other end of the tube is connected with and reacted against the associated upward release mechanism. The rod is preferably spaced, at least sideways, from the internal wall of the tube so that movements of the rod taking place on operation of the sideways release mechanism are not restricted by the tube.

It is especially advantageous for the compression springs to be connected to the tube and rod via first and second abutment nuts. By rotation of these abutment nuts the release settings of the release springs can be adjusted.

For ski bindings capable of releasing sideways and upwardly it is generally desirable to be able to adjust the two release settings in dependence of one another. Especially preferred embodiment of the invention make use of abutment nuts that are coupled together so that relative rotation is prevented but so as to allow relative axial displacement. This arrangement has the benefit that by rotation of a single externally accessible abutment nut the adjustment of both release settings is simultaneously achieved without disturbing the independence of the upward and sideways release mechanisms because the abutment nuts have the possibility to move relative to one another in the axial direction during release movements.

In one especially practicable embodiment the abutment nut for the inner spring is located within a cavity provided in the other abutment nut and this latter abutment nut is accessible from the end of the binding remote from the sole clamp.

In order additionally to allow a differential adjustment of the sideways and upward release settings a further embodiment includes an internally threaded ring fitted onto the outermost abutment nut so that this ring forms the direct abutment for the outer spring. By rotation of this threaded ring the release setting of the outer spring can be adjusted independently from the release setting of the inner spring.

A further, likewise readily practicable embodiment is characterized by a dowel passing eccentrically through the abutment nut for the outer spring and engaging with the other abutment nut so that axial displacement is possible between the two abutment nuts but relative rotation between them is not possible. The dowel is usefully externally disengageable from the inner abutment nut. In this manner the release settings of the two springs can be jointly or independently adjusted as desired. When the upward and sideways release springs are constructed as compression springs it is convenient for the ends of the springs adjacent the sole clamp to bear on a transverse step or intermediate wall of the housing.

Advantageously an upward release cam track is arranged between the end of the tube adjacent the sole clamp and a base plate on which the housing is pivotally mounted. In this arrangement it is convenient for journals to be provided at each side of the said end of the tube and for these to cooperate with the upward release cam track which is itself conveniently attached to the base plate. It is, however, also possible to arrange a link means between the said end of the tube and the cam track, the link means being pivoted about a transverse axis within the housing and itself carrying the journals which cooperate with the upward release cam track. This arrangement provides greater freedom in selecting the upward release characteristics of the binding. The rod usefully projects beyond the end of the tube adjacent the sole clamp so that it is spaced by a desired amount from the upward release mechanism and so that the end of the rod can be connected to the sole clamp and sideways release mechanism without constructional or spatial problems.

Usefully the projecting end of the rod is connected to the sole clamp about a vertical pivot axis and the sole clamp is located relative to the housing by means of two pairs of complementary abutment surfaces provided on the sole clamp and the housing respectively and located one to either side of the rod, the arrangement being such that the tensile force transmitted via the rod presses the pairs of complementary abutment surfaces into contact with each other.

In a further alternative the sole clamp can be formed as two sole clamp halves each capable of pivotal movement to a respective side of the binding, there being provided respective first and second journals provided on the two sole clamp halves each of which cooperates with a corresponding cam track surface provided on respective sides of a yoke carried at the projecting end of the rod.

A tube has been necessary in the previous embodiments to transmit the release force from the upward release spring to the upward release mechanism, an especially preferred embodiment which allows this tube to be deleted features an arrangement in which said housing is provided with a transverse wall, said upward release spring being disposed on one side of said wall remote from said sole clamp, the associated upward release mechanism being located on the other side of said wall adjacent said sole clamp, and there being at least one passage through said wall for communicating the force from the upward release spring to the upward release mechanism. The sideways release spring is also a compression spring bearing at its one end on said transverse wall and being connected to said sole clamp via an abutment at its other end and a rod passing through the housing and through a further opening in said transverse wall.

This construction means that the transverse wall provides an abutment surface for locating one end of the inner sideways release spring relative to the housing with a corresponding opening adapted to accommodate the associated rod. Moreover, it is also possible to transmit the force from the outer compression upward release spring directly to the mechanical components of the associated upward release mechanism. The direct mechanical connection of the outer upward release spring to the upward release mechanism can usefully take place in the vicinity of the two ends of the springs adjacent the sole clamp.

In a preferred version of this embodiment the supporting transverse wall part of the housing extends from the upper surface of the housing downwardly and at least one, and preferably two, openings are provided in the transverse wall at one or both sides of the housing. The rigid structural connection of the transverse wall to the housing is provided in this embodiment at the upper part of the housing.

In a further version of this embodiment the upward release mechanism comprises link means pivotally connected about a transverse axis relative to the housing.

The link means preferably comprise first and second links respectively arranged in the openings to either side of the housing so that the force of the outer upward release spring can be directly communicated to the links. The links are preferably pivotally connected into the upper part of the housing and extend downwardly from this pivot point.

One of the elements of the upward release mechanism-defined by cooperating journal means and a release cam track-is preferably arranged at the end of the link means remote from the pivot point. This element is preferably the jounnal means and in this arrangement the release cam track is then preferably fastened to a base plate fastened to the ski.

Advantageously the link means is formed as two separate links which are connected together at their lower ends by a cylindrical member which defines the journal means. This arrangement provides a stable link unit. The links are preferably made from sheet metal and the openings at the sides of the housing are preferably formed as slits through which the sheet metal links can readily extend. The transverse supporting wall of the housing can in this manner be made relatively wide so that the abutment surface for the inner spring has the required size. Furthermore, the spring loads can be transmitted to the sheet metal links via their narrow side edges so that the links can have the necessary degree of stability for the transmission of the upward release forces.

The journal means is advantageously located beneath the lower end of the transverse wall housing so that the range of pivotal movement of the journal means with the links is not limited by the transverse wall.

In order to ensure a uniform transmission of force to both of the links a particularly advantageous embodiment envisages an abutment ring, preferably a metal abutment ring disposed between the links and the end of the outer spring. The abutment ring can be provided with recesses at its point of contact with the links. The links themselves can conveniently be provided with rounded camlike projections at their points of contact on the abutment ring and the recesses are preferably correspondingly rounded to suit the projections. This arrangement makes the sliding of the surfaces of the links during upward release somewhat easier.

A bearing ring can also be arranged between the abutment ring and the end of the spring and is preferably formed in a synthetic material with an annular projection which ensures the relative sideways alignment of the outer spring and the abutment ring.

In a further modification the transverse wall of the housing can have an upwardly directed recess which is adapted to facilitate the assembly of the upward release mechanism. The end face of the transverse wall remote from the sole clamp is arranged to extend further downwardly than the above mentioned recess. It should not, however, extend as far as the base of the housing in order to allow a sufficient range of pivotal movement of the journal means.

It is also advantageous for a recess to be provided in the transverse wall of the housing so that an indicator can be arranged within this recess to show the release setting of this sideways release spring. This recess can conveniently be closed by a transparent window. The length of this recess is however restricted in the direction towards the sole clamp in order to allow the transverse wall to be connected with the housing at this point.

In embodiments in which the link means comprises two links each of these links is preferably pivotally connected to the housing via a respective headed pin. In an arrangement of this kind the recess adapted to facilitate assembly of the upward release mechanism is preferably provided with first and second recesses in its side walls which are adapted to accommodate the heads of the headed pins.

BRIEF DESCRIPTION OF THE DRAWINGS

The invention will now be described in greater detail by way of example only and with reference to the accompanying drawings in which are shown.

DETAILED DESCRIPTION OF PREFERRED EMBODIMENTS

Figures 1, 1A, 2, 3, 4:
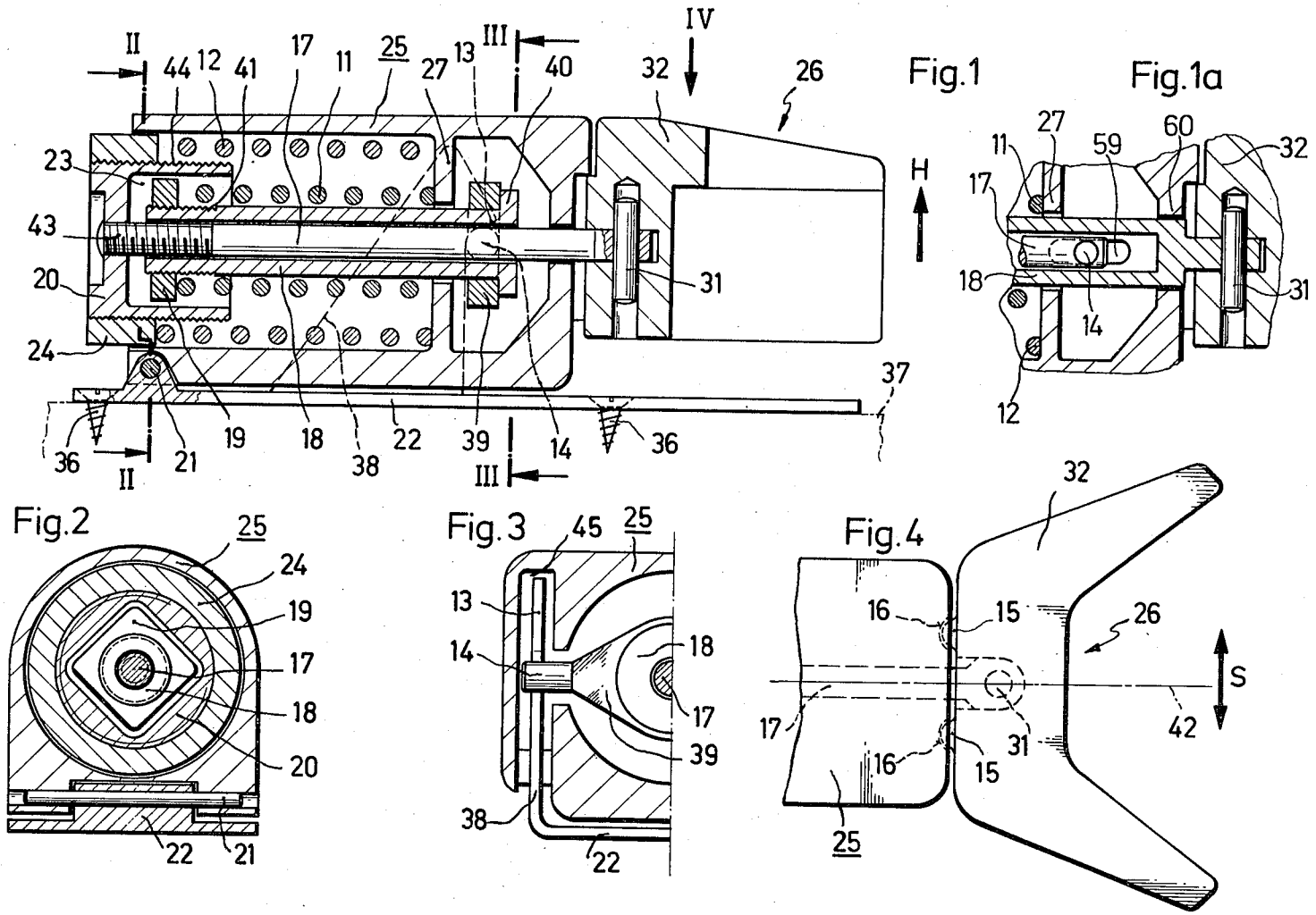
FIG. 1 a vertical section of a safety binding for a ski taken on the central longitudinal plane, FIG. 1*a* a modification of the subject of FIG. 1, FIG. 2 a section on the line II-II of FIG. 1, FIG. 3 a half section taken on the line III-III of FIG. 1, FIG. 4 a plan view of the forward end of the safety binding shown in FIGS. 1 to 3, FIG. 5 a part vertical section similar to FIG. 1 of a further embodiment of a safety binding, FIG. 6 a section on the line VI-VI of FIG. 5, FIG. 7 a partly sectioned side view similar to FIG. 1 of a further embodiment of the safety binding, FIG. 8 a section on the line VIII-VIII of FIG. 7, FIG. 9 a partly sectioned side view similar to FIG. 1 of a further embodiment of a safety binding, FIG. 10 a partly sectioned view of one half of a ski binding taken on the line X-X of FIG. 9, FIG. 11 a partly sectioned side view similar to that of FIG. 1 of a further embodiment of a safety binding, FIG. 12 a section on the line XII-XII of FIG. 11, FIG. 13 a part vertical section of an embodiment of a safety binding adapted to utilize tension springs, FIG. 14 a partly sectioned side view of a further safety binding, FIG. 15 a part horizontal section through the central longitudinal plane of the embodiment of FIG. 14, FIG. 16 a section on the line XVI-XVI of FIG. 14 and FIG. 17 a view similar to that of FIG. 14 but showing the safety binding in its raised position following an upward release.

Referring first of all to FIGS. 1 to 4 there is shown the toe unit of a safety binding for a ski and which basically comprises a housing part 25, a base plate 22 and a sole clamp 26. The base plate 22 can be fixed in the usual way to a ski such as 37 via screws 36. The ski 37 can be imagined extending from the right to the left of the drawing with the ski tip being disposed to the left of the drawing and the direction of the ski defining the forward direction for the purposes of the subsequent description. Although this embodiment is described with reference to a toe unit the invention can be used in a completely analogous manner for the heel unit of a safety binding for a ski with the same advantages.

As can be seen from the drawings the housing 25 is pivotally connected to the base plate 22 via a transverse pivot axis 21. The sole clamp 26 at the rear of the toe unit is shaped to provide an undercut recess for locating the forward portion of the sole of a ski boot. The sole clamp 26 which in general comprises the single member 32 is carried by the housing 25 and is located in its illustrated position via two release mechanisms generally located within the housing 25. The first release mechanism allows the sole clamp 26 to move upwardly to release a ski shoe following a forward fall and the second release mechanism allows the sole clamp 26 to move to either the left or right hand side of the ski to effect a sideways release of the ski boot following a fall. Upward release of the sole clamp 26 takes place by a pivotal movement of the housing and sole clamp about the transverse pivot axle or pin 21 which is located at the forward end of the housing so that the housing and sole clamp can freely pivot upwardly about this axis during the upward release.

The first upward release mechanism comprises two side plates or components 38 which are bent upwardly from the base plate 22 and which, as can be readily seen from FIG. 3, project into recesses within the housing 25. The front edges of the side plates are provided with cam tracks 13 which cooperate with respective cylindrical members 14 which are pressed against the surfaces of the cam tracks by pressure applied from a yoke 39. The yoke 39 is arranged at one end of a tube 18 which has a flange 40 which engages behind the yoke 39 in order to transmit pressure to the yoke 39 for holding the cylindrical members 14 in contact with the cam track 13 and it is this force that opposes the upward release of the sole clamp. A recess in the surface of the cam track locates the sole clamp in the closed position.

The tube 18 passes through a bore provided in a transverse wall 27 of the housing and extends from its end adjacent the sole clamp to almost the forward end of housing 25. The forward end of the tube 18 is externally threaded at 41 and a nut 19 can be moved up and down the threads 41. A compression coil spring arranged coaxially around the tube 18 extends between the abutment formed by the nut 19 and the intermediate wall 27 and it is this spring which generates, via the abutment 19 the tube 18, the yoke 39 and the cylindrical members 14, the force which opposes movement of the cylindrical members up the cam track 13 and which thus opposes the upward release of the sole clamp 26. Once a predetermined upward force H is achieved the cylindrical members 14 slide upwardly along the cam track 13 while simultaneously displacing the tube 18 rearwardly towards the sole clamp 32 and compressing the spring 11 until the cylindrical members slide past the apexes on the cam tracks 13 whereupon the effect of the spring is to pivot the housing 25 upwardly about the axle or pin 21 without requiring any further force to be transmitted from the ski boot to the binding.

The second, sideways release mechanism is provided by two pairs of complementary abutting surfaces 16 and 15 located one to either side of the central longitudinal axis of the binding. As can be seen from FIG. 4 the complementary abutting surfaces 15 and 16 take the form of recesses 16 in the housing 25 and corresponding noses 15 provided on the forward surface of the sole clamp 26. A rod 17 is pivotally connected at its one end by a vertical journal 31 to the sole clamp 32. The rod 17 then extends through the housing along the center of the tube 18 to the forward end of the housing 25 where it is connected by screw threads 43 to an adjustable abutment nut 20. The adjustable abutment nut 20 has a larger diameter than the abutment 19 and has, in its rearward facing end face, a space 23 which is of other than round section, e.g. of square section and the abutment 19 which is correspondingly shaped is located within this space 23. In this manner relative rotation of the two abutments 19 and 20 is avoided while allowing them the possibility of moving axially relative to one another.

The abutment nut 20 is provided with screw threads on its outer periphery onto which is screwed an internally threaded ring 24. A second compression coil spring 12 extends between the ring 24 and the intermediate wall 27 of the housing 25 and has a larger diameter than the concentrically arranged coil spring 11. The two coil springs take up, however, essentially the same amount of length within the housing 25. The outer sideways release spring 12 exerts a force via the abutment ring 24, the abutment nut 20, the rod 17 and the vertical journal 31 which pulls the noses 15 and the recesses 16 into contact with each other and thus locates the sole clamp 32 against the housing 25. If a sideways force should be applied to the sole clamp 26 which exceeds a predetermined value S (FIG. 4) and which is directed either to the right or left hand side of the sole clamp, then the sole clamp 32 pivots in the corresponding direction while simultaneously drawing the rod 17 out of the housing 25. This movement of the rod 17 produces a corresponding compression of the coil spring 12. The sideways release achieved in this manner is clearly completely independent from the upward release which is, therefore, not affected by the occurrence of a sideways release.

By rotating the abutment nut 20 which is accessible from outside the binding, the release tensions of the two concentrically arranged compression coil springs 11, 12 can be jointly adjusted. If, however, only the abutment ring 24 is rotated, which can likewise be achieved from outside of the binding housing, then only the release setting of the side release spring 12 is adjusted. Thus both joint and independent adjustments of the upward and sideways release settings are possible.

As can be seen from FIG. 3 the housing 25 is conveniently provided with two recesses 45 into which the side members 38 project.

FIG. 1*a* shows an inversion of the arrangement of FIGS. 1 to 4 in which the inner coil spring 11 is utilized for the side release mechanism and the outer coil spring 12 for the upward release mechanism. This is achieved by extending the tube 18 rearwardly to the sole clamp 32 and pivotally connecting it thereto via the journal 31. The tube 18 thus passes through the parts 27 and 60 and these must be provided with the necessary amount of sideways clearance. The rod 17 finishes inside of the tube 18 and the two cylindrical members 14 are carried directly by the rod 17 and project through elongate slots 59 in the horizontal side walls of the tube 18.

Further embodiments and modifications of the invention will now be described in the following figures and elements of the construction having corresponding counterparts in FIGS. 1 to 4 will be designated by the same reference numerals.

Figure 6:
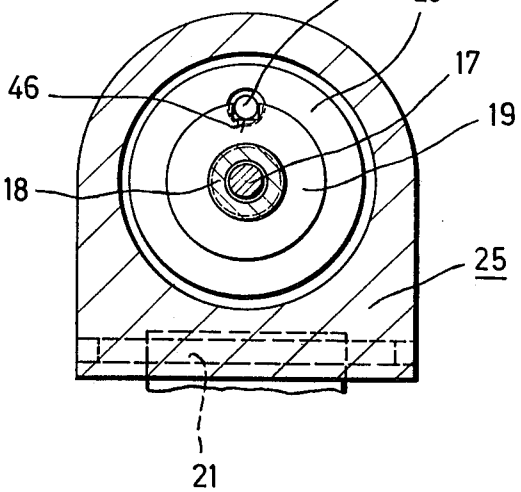
Figure 5:
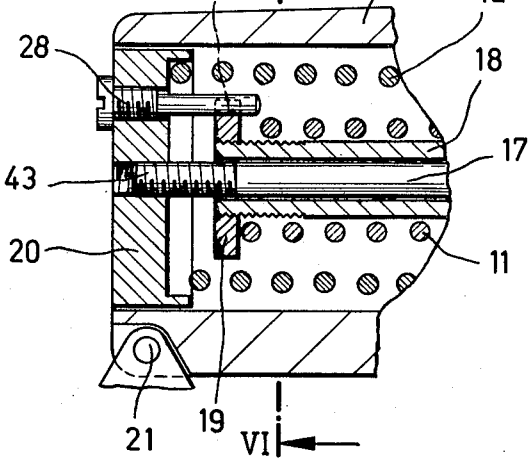

Turning now to the embodiments shown in FIGS. 5 and 6 the externally accessible abutment nut 20 is once more shown connected via screw threads 43 to a rod 17. A dowel 28 is screw-threaded into the abutment nut 20 away from the axis thereof and passes through a groove 46 provided in the periphery of the abutment nut 19 so that rotation of the abutment nut 20 results in corresponding rotation of the coaxially arranged abutment nut 19. The dowel 28 is made elongate so that the axial relative displacements of the two abutment nuts 19 and 20 occasioned by upward or side release of the binding can still take place independently of each other.

By withdrawing the screw-threaded dowel 28 which can readily be done from outside the binding, the rotational coupling of the two abutment nuts 19 and 20 can be temporarily released so that independent adjustments of the two release settings, i.e. of the precompression in the two springs 11 and 12 are also possible.

Figure 7:
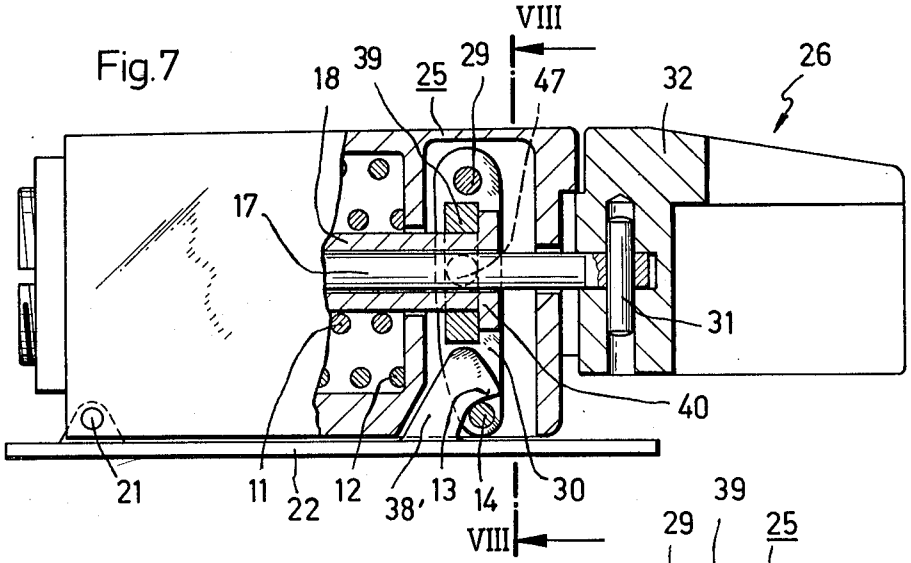
Figure 8:
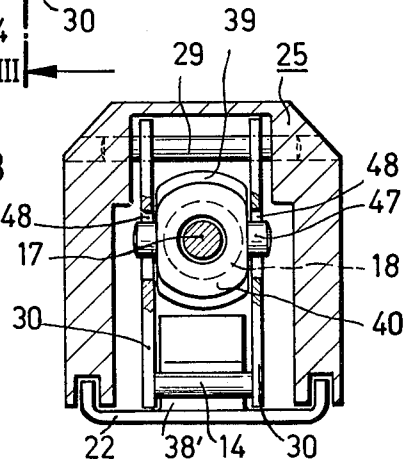

FIGS. 7 and 8 show a further modification in which upward release of the sole clamp 26 is controlled by the rear end of the tube 18.

In this embodiment the side mounted cylindrical members 47 of the yoke 39 are arranged within two substantially vertical elongate slots 48 in two vertically disposed links 30 which are pivotally connected at their upper ends by a transverse pin 29 to the housing 25. The links 30 can pivot forwardly and rearwardly about the pin 29. At their lower ends the links are connected together by a transverse journal 14 which cooperates with a cam track 13 carried on a member or, component 38 which is itself connected to the base plate 22.

In this embodiment upward release takes place in an analogous manner to the upward release of the embodiment of FIGS. 1 to 4. The resetting forces are, however, transmitted onto the cam track 13 via the cylindrical members 47, the links 30 and the transverse journal 14. The arrangement of the links gives rise to another possibility for influencing the release setting of the upward release mechanism. It is important that the tube 18 has the possibility of undergoing a certain deflection in the vertical direction on pivotal movement of the links 30 about the axis of the transverse pin 29. Alternatively, as can be seen in FIG. 8, the cylindrical members 47 can engage within a substantially vertically arranged elongate slot 48 so that the cylindrical members 47 can move by a certain amount within the elongate slots 48 on pivotal movement of the links 30.

Figure 9:
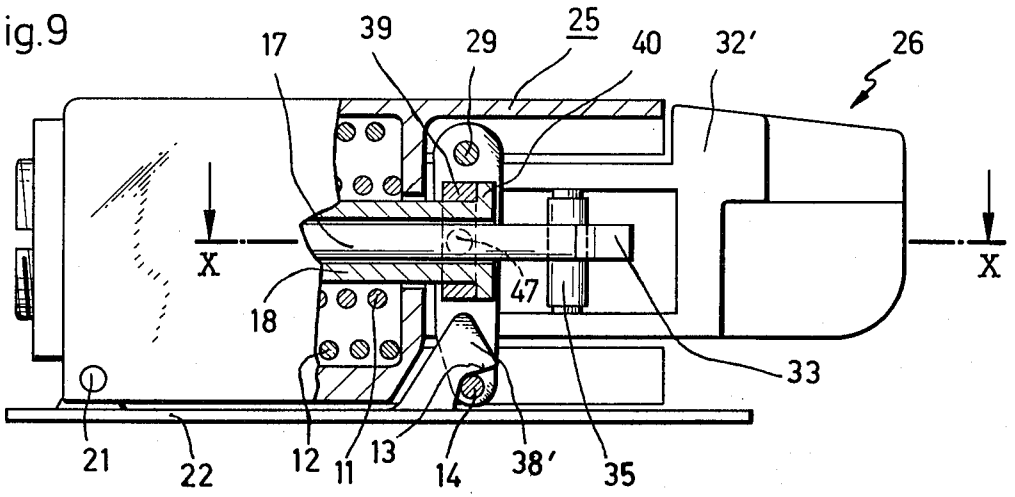
Figure 10:
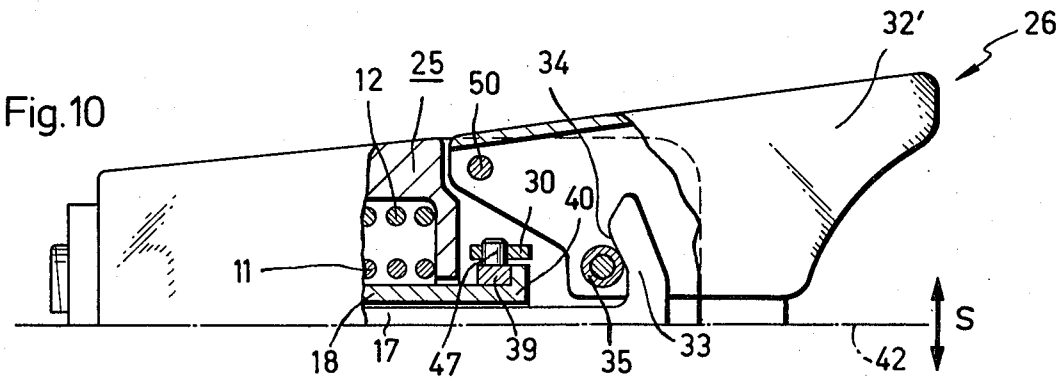

Turning now to FIGS. 9 and 10 there is shown a modified embodiment similar to that of FIGS. 7 and 8. FIGS. 9 and 10, however, show a further alternative way of arranging the sideways release of the binding. The sole clamp 26 of this embodiment comprises two distinct left and right hand halves. Each half of the sole clamp is pivotable about a respective axis 50 disposed on the associated side of housing 25. Only the right hand sole clamp half 32' can be seen in FIGS. 9 and 10 but it will be understood that the left hand half is completely symmetrical about the center line 42.

The sole clamp halves 32' carry vertically arranged release journals 35 which cooperate with a cam track 34 formed on a yoke 33 which is pivotably or preferably rigidly connected across the rearward end of the rod 17. Once the predetermined sideways release force S is reached the appropriate sole clamp half pivots outwardly about the vertical axis 50 while the journal 35 moves up the cam surface 34. The movement of the journal up the cam surface pulls on rod 17 which is displaced towards the sole clamp 26 while compressing the spring 12. Once the apex point of the cam track 34 has been reached the relevant sole clamp part 32' is released sideways.

Figure 11:
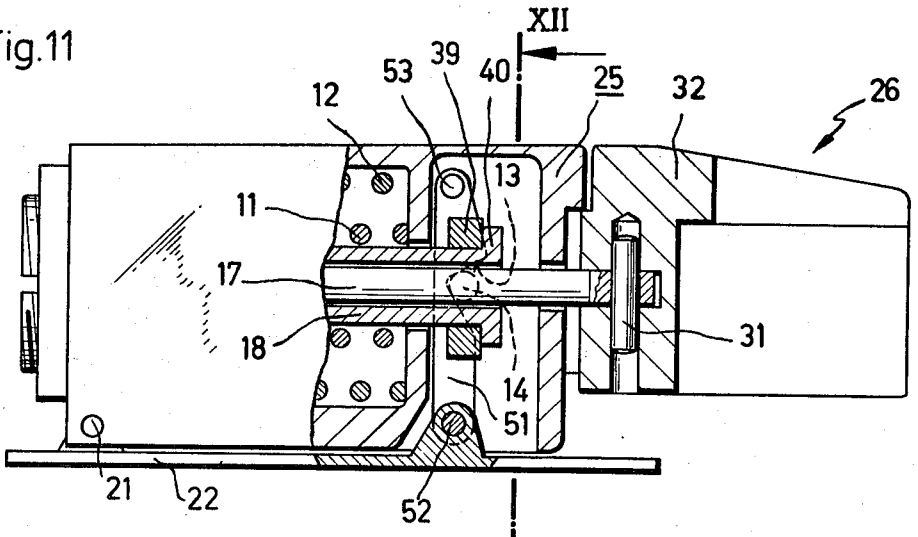
Figure 12:
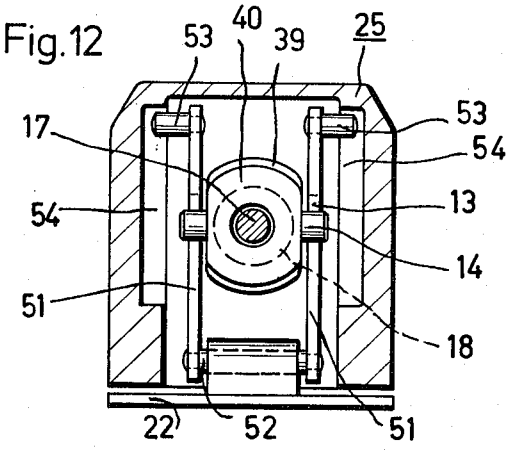

Turning now to FIGS. 11 and 12 there is shown a further embodiment which corresponds largely with that of the embodiment of FIGS. 1 to 4 except that the upward release is brought about through two links 51. The links 51 are pivotally fastened at their lower ends about a pivot axis 52 to the base plate 22. The links are themselves provided with a cam track 13 on their rear surfaces at a vertical position corresponding to the level of the cylindrical members 14 which project sideways from the yoke 39. During upward release the cylindrical members 14 run up the cam tracks 13.

At the upper ends of the links there are provided respective sideways projecting pins 53 which run in corresponding side slots 54 of the housing 25. The slots 54 extend in a generally vertical direction and ensure that the links 51 are held as exactly as possible in a vertical direction during upward release. Alternatively the slots 54 can be curved or inclined relative to the vertical direction so that the precise mechanical conditions prevailing during release can be tuned in any desired sense to adjust the characteristics of the upward release.

It will be noted that the principle of using two springs, one located within the other, can be applied to all the foregoing embodiments quite independently from the type of release mechanism that is employed, i.e. a cam system, a system with two complementary abutting side pivot surfaces, or a pliers action two part sole clamp system etc.

Figure 13:
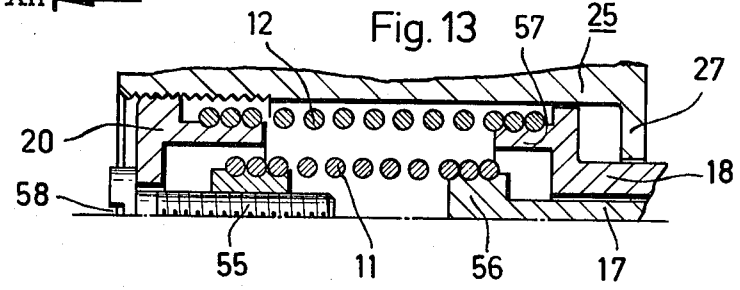

The principle can also be used with tension coil springs as is illustrated in FIG. 13. In the embodiment of FIG. 13 the inner tension coil spring 11 is screwed onto the abutment nut 19 and is thereby fastened thereto. A screw 55 passing centrally through the abutment nut 20 connects the abutment nut 19 with the abutment nut 20.

The other end of the inner spring 11 is screwed onto an enlarged forward end portion of the rod 17. The rod 17 extends, as before, through an enlarged opening provided in the intermediate wall 27 of the housing 25. In similar fashion the tube 18 is also enlarged at its forward end 57 and the rear end of the outer tension spring 12 is screwed onto this enlargement 57. The other end of the tension spring 12 is threaded onto a corresponding projection on the abutment nut 20.

As can be seen from FIG. 13 the rod 17 and the tube 18 can be made considerably shorter by the use of tension springs 11 and 12. It is necessary for the friction between the screw 55 and the abutment nut 20 to be so arranged that on rotation of the abutment nut 20 the screw 55 turns together therewith. On the other hand the abutment nut 20 should not rotate with the screw 55 when this is turned by inserting a screw driver into the slot 58 which is provided for rotating the screw 55. In this way both joint and independent adjustment of the two release springs 11 and 12 is possible. The effects of the springs 11 and 12 in relation to side or upward release can once more be exchanged in a manner similar to that shown in FIG. 1*a*.

It is also basically possible for both the tension springs to extend, located one within the other, directly up to their respective release mechanisms.

Although the spring arrangements shown in the preceding exemplary embodiments are the preferred arrangements the outer and inner springs can be used as desired for either sideways or upward release.

Furthermore, the threads on the abutment nuts 19 and 20 can be provided with differential pitches so that, depending on the adjustment and stiffness of the springs, the relationship between the forces required for sideways and upward release can be made to change relative to one another by desired amounts in the desired sense on adjustment of the release settings. Similarly various adjustment routes can be utilized for the inner or the outer springs.

As relatively trivial tolerances will always be associated with the transverse pin 21 on which the housing 25 is pivotally mounted it is desirable to stabilize the sideways position of the housing, e.g. by the method shown in FIG. 8 in which two projections from the base plate 22 are located in corresponding grooves formed in the lower walls of the housing 25.

Referring finally to FIGS. 14 to 17 there is shown an especially preferred ski binding capable of upward and sideways release. The binding can be used as either a toe unit or a heel unit. As in the preceding embodiments a housing 25 is pivotally mounted about a transverse pivot axis 21 on the base plate 22, the base plate 22 being fastened to a ski 37 via screws 36. The embodiment shown is a toe unit and, as before, the housing 25 carries a sole clamp 26 at its rear end. The sole clamp 26 is largely formed by the one piece member 32 which is provided with the necessary undercuts for locating the sole of the ski shoe. The transverse pivot axle or pin 21 is located at the forward end of the housing remote from the sole clamp 26 in order to allow an unhindered upward pivotal movement of the housing 25 during upward release.

The upward release means has a component 38 which extends upwardly from the base plate and whose forward face is shaped to define a release cam track 13. This cam track 13 cooperates with a cylindrical journal 14, which defines a latch member, and which connects together the bottom ends of two pivoted links 30. The pivoted links 30 are formed from pressed sheet metal parts and are arranged with their planes at right angles to the transverse direction. At their upper ends the links 30 are pivotally connected to the housing 25 by means of transverse pivot pins 29 having heads 61.

Figure 16:
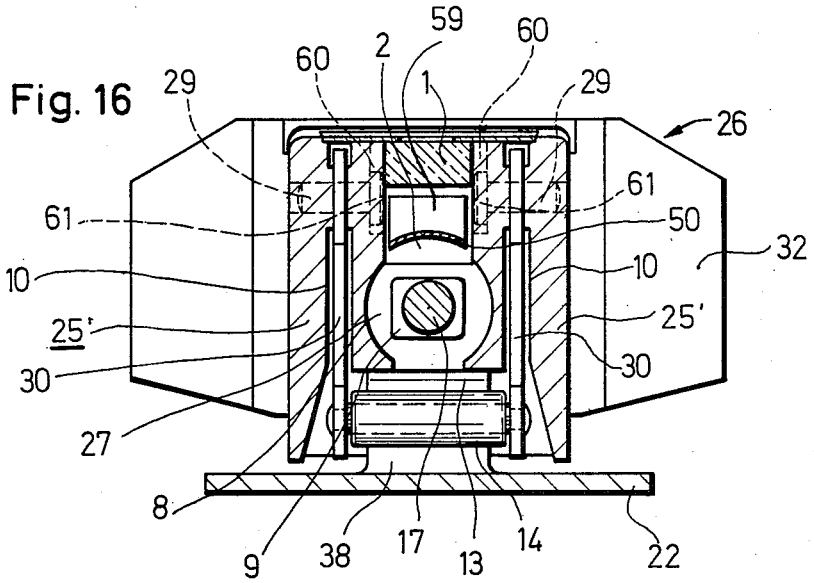

As can be seen from FIG. 16 the pivoted links 30 extend through slit-like openings 10 formed between the side regions 25' of the housing 25 and a transverse wall or housing part 27 which extends downwardly through the housing 25 from a bridge of material, at the upper part of the housing. The housing part 27 has a real wall 62 which is located against the sole clamp 32.

Figure 14:
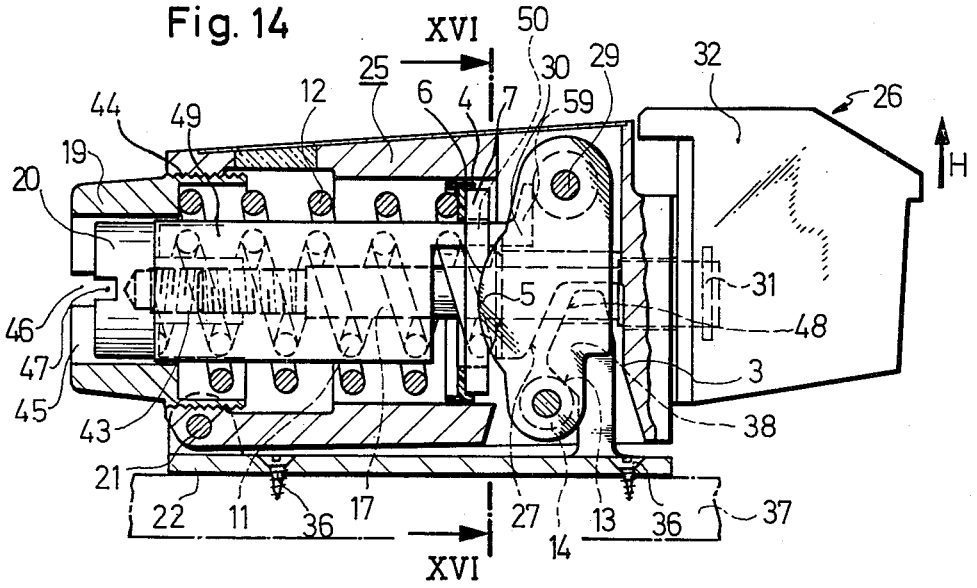

The component 38 having the cam track 13 extends, as can be seen in FIG. 14, in the closed position of the binding, prior to upward release, into a recess 3 of the housing part 27. The part 27 projects at its end remote from the sole clamp 32 downwardly through the housing 25 in order to define with its forward end face a generally circular abutment face 8 for an inner release coil spring 11. The other end of this inner spring 11 sits on an abutment nut 20 which is screw-threaded onto the threaded end 43 of a rod 17 which passes rearwardly through the center of the inner spring 11 and through an opening 9 in the central region of the housing part 27 and is pivotally connected to the sole clamp 32 at the vertical pin 31. The opening 9 in the housing part 27 is made larger than the rod 17 in order to provide sideways clearance. As a result of this construction the inner spring 11 pulls the sole clamp 32 via the rod 17 against two pairs of complementary abutting surfaces disposed to either side of the central longitudinal axis of the housing 25. These complementary abutting surfaces have the form of nose-like projections 15 provided on the housing 25 which cooperate with corresponding recesses formed in the sole clamp 26. As before, the purpose of each of these pairs of complementary abutting surfaces is to define a vertical axis to either side of the longitudinal axis of the binding about which the sole clamp 26 can pivot to effect sideways release of a ski boot. Thus, in equivalent manner to that previously described, sideways release of a ski boot can take place once a force in the direction S exceeds the sideways release setting of the binding. As the sole clamp 26 pivots about the complementary abutting surfaces, defined e.g. on the right hand side of the toe unit shown in FIG. 15 by the cooperating abutment elements 15 and 16, the inner release spring 11 is compressed by the associated movement of the rod 17. The sideways release in the other direction i.e. to the left of FIG. 15 takes place in exactly similar manner by pivoting of the sole clamp 26 about the other pair of complementary abutting surfaces.

The upward release mechanism formed between the cam track 13 and the latching journal 14 is biased into its closed position by an outer compression coil spring 12 which is located concentrically to the inner spring 11 but has a larger diameter. The end of the outer coil spring 12 remote from the sole clamp 32 bears on an abutment nut 19 which is screwed into the housing via a thread 44 provided at the forward face of the housing. The abutment nut 19 has an internal space 45 into which the previously mentioned abutment nut 20 for the inner spring 11 is freely rotatably arranged.

Both the abutment nut 20 and the abutment screw 19 are provided with actuating slits 46 and 47 in their end faces into which a screw driver or a coin can be inserted. Depending on the tool used the abutment nut 20 and the adjustment screw 19 can be adjusted either independently from one another or jointly.

The end of the outer upward release spring 12 is arranged in a synthetic bearing ring 4 which has an external annular border and which bears at its rearward end face on an abutment ring 7. The abutment ring 7 is preferably made in metal and has rounded depressions 6 at its two sides (FIG. 14) into which project correspondingly rounded projections 5 formed on the front edges of the links 30. In this manner the release force of the spring 12 is transmitted to the latching journal 14 via the ring 4, the abutment ring 7 and the links 30.

Figure 15:
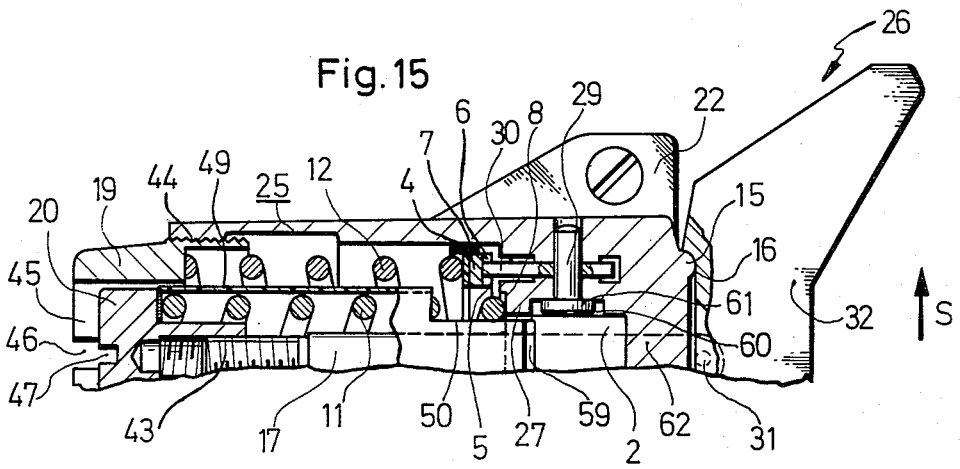

A further cut-out or recess 2 is provided in the upper region of the housing part 27 which, as can be seen from FIG. 15, only extends from the rear ends of the springs 11 and 12 to the wall or material bridge 62. In this recess there are located transverse depressions 60 which accommodate the heads 61 of the transverse pivot pins 29. The transverse pivot pins can, therefore, be inserted into their respective transverse bores via the recess 2.

In addition an indicator member 59 is arranged within the recess 2 which is visible through a transparent window 1 which closes the recess 2 and is so connected, via a web 50 and a synthetic tube 49 which is suited to the round form of the spring 11, that it cooperates in the movement of the spring 11 in the longitudinal direction. In this way the indicating device 59 shows the release setting of the inner spring 11. A further window 23 which is provided in the vicinity of the inner border of the adjustable abutment screw 19 makes it possible to see the position of the inner edge of the abutment screw 19 which in a similar fashion allows the release setting of the outer spring 12 to be assessed. As seen in FIG. 16 the indicating device 59 and the web 50 are shaped to fit within the recess 2, which preferably is of rectangular section so that the connecting member 50 is actually guided by the recess and is prevented from rotating about the longitudinal axis of the coil spring 11.

Figure 17:
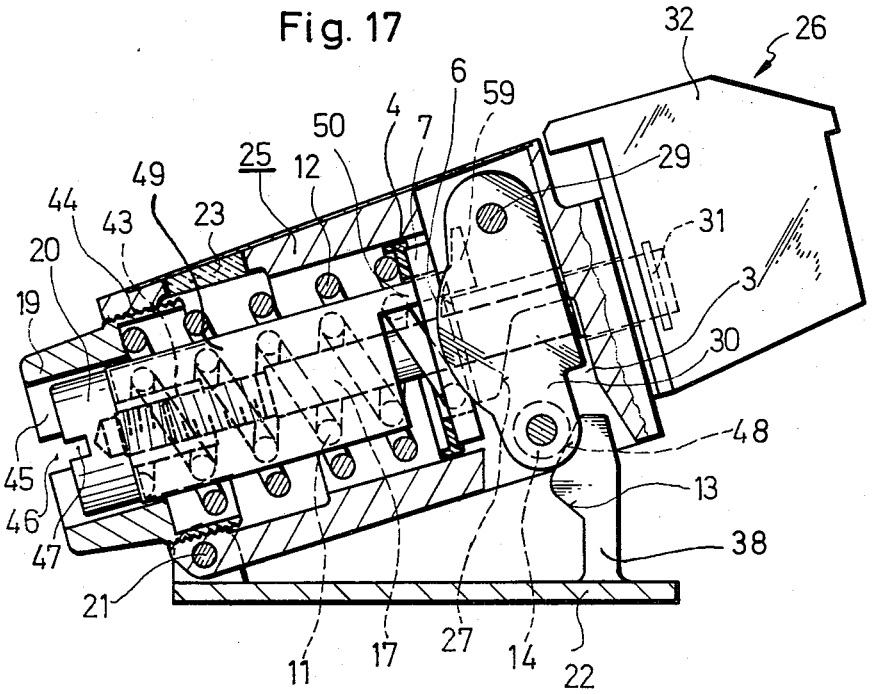

The function of the ski safety binding shown in FIGS. 14 to 17 is as follows:

Should an excessive force be applied to the toe unit in the direction of the arrow H of FIG. 14 then the housing 25 rotates upwardly about the transverse pin 21 into the position shown in FIG. 17. During this movement the latching journals 14 run past an apex point defined on the cam track 13. Through this movement the outer release compression spring 12 is compressed via the links 30, the support ring 7 and the ring 4. The inclined surface 48 provided on the front face of the cam track 13 at the upper part of the component 38 then makes it possible for the force exerted by the spring 12 to urge the housing 25 into the open position shown in FIG. 17. Furthermore, this inclined surface allows the binding to be closed by the application of hand pressure downwardly so that the housing moves from the FIG. 17 to the FIG. 14 position.

Sideways release takes place completely independently from upward release when an excessive force occurs in the direction of the arrow S shown in FIG. 15.

On the occurrence of such a force S the complementary abutment surfaces 16 can pivot about their respective complementary abutment surfaces, the nose-like projections 15, and the inner spring 11 is compressed via the rod 17. The arrangement disclosed in FIGS. 14 to 17 allows the release settings of the release springs to be independently adjusted, by inserting a tool either into the slot 46 or the slot 47, or to be jointly adjusted by inserting a tool simultaneously into both slots.

I claim:

1. A safety binding for a ski comprising: a housing pivotally mounted about a transverse axis, a sole clamp carried by said housing, an upward release mechanism incorporating an adjustable upward release spring and operative to locate the housing and the sole clamp in a closed position and also to release said housing and said sole clamp for upward pivotal movement about said transverse axis once the release setting of said upward release spring is exceeded, a sideways release mechanism incorporating an adjustable sideways release spring one end of which bears against said housing, said sideways release mechanism being operative to locate the sole clamp sideways while allowing the sole clamp to be displaced sideways to either side of said housing once the release setting of the sideways release spring is exceeded, said upward and sideways release springs being coil springs of different diameters and located one within the other, said housing being provided with a transverse wall, said upward release spring being disposed on one side of said wall remote from said sole clamp, said upward release mechanism being located on the other side of said wall adjacent said sole clamp, there being at least one passage through said wall for communicating the force from the upward release spring to the upward release mechanism, the sideways release spring being a compression spring bearing at its one end on said transverse wall and being connected to said sole clamp via an abutment at its other end and a rod passing through the housing and through a further opening in said wall.

2. A safety binding according to claim 1 in which said transverse wall extends from the top surface of said housing downwardly and wherein said at least one passage comprises first and second openings provided in said transverse wall to either side of the housing and on either side of said further opening.

3. A safety binding according to claim 1 and in which said upward release mechanism further comprises link means pivotally mounted about a transverse pivot axis within said housing and located within said at least one opening, the upward release spring bearing on said link means.

4. A safety binding according to claim 3 and in which said link means pivotally connected to said housing about a transverse pivot axis located in the upper portion of said housing, the link means extending downwardly through the housing.

5. A safety binding according to claim 3 and in which the end of said link means remote from said pivot axis is provided with journal means cooperable with an upward release cam track attached to a base plate on which said housing is pivotally mounted.

6. A safety binding according to claim 5 and in which said link means comprises first and second links disposed one to either side of the housing and interconnected by a cylindrical member defining said journal means.

7. A safety binding according to claim 5 and in which said journal means extends downwardly beyond the lowermost portion of said transverse wall.

8. A safety binding according to claim 3 and in which said link means comprise sheet metal parts.

9. A safety binding according to claim 3 and in which an abutment ring is located between said upward release spring and said link means.

10. A safety binding according to claim 9 and in which said abutment ring is a metal ring.

11. A safety binding according to claim 9 and in which said abutment ring is provided with recesses at its point of contact with said link means.

12. A safety binding according to claim 11 and in which at the point of contact between the link means and the abutment ring the link means is provided with cam-like rounded projections and said recesses have a corresponding rounded shape.

13. A safety binding according to claim 9 and in which a bearing ring is interposed between said abutment ring and said spring.

14. A safety binding according to claim 3 and in which the transverse wall of said housing is provided with an upwardly extending recess adapted to permit assembly of said upward release mechanism.

15. A safety binding according to claim 14 and in which said link means comprises first and second downwardly extending links each said link being respectively pivotally connected to said housing via a headed pin, there being provided first and second depressions in the side of said recess for receiving the heads of said headed pins.

16. A safety binding according to claim 1 and in which said at least one opening for communicating the force of said upward release spring to said upward release mechanism comprises first and second elongate slots provided one to either side of the housing.

17. A safety binding according to claim 1 and in which a recess is provided above said at least one opening there being disposed within said recess means responsive to the adjustment of said sideways release spring for indicating the release setting thereof.

18. A safety binding according to claim 17 and in which said recess is closed by means of a transparent window.

19. A safety binding in accordance with claim 18 and wherein a second indicator device visible through a second transparent window in said housing is provided in respect of said second coil spring, with said second window being provided on the same side of said transverse wall as said second coil spring.

20. A safety binding for a ski comprising: a base plate for mounting the binding on a ski, a housing pivotally mounted about transverse axle means supported by said base plate, sole clamp means carried by said housing, an upward release mechanism, and a sideways release mechanism, said sole clamp means being pivotable with said housing, against a retaining force exerted by said upward release mechanism about said transverse axle means, from a skiing position to a vertically released position of the binding, said sole clamp means being angularly displaceable sideways relative to the housing, against a retaining force exerted by said sideways release mechanism, from said skiing position to a sideways released position; said sideways release mechanism comprising a first coil spring located within said housing and having a first end located by the housing, and a second end associated with rod means for drawing said sole clamp means into said skiing position on said housing; said upward release mechanism comprising a second coil spring substantially concentrically disposed relative to said first coil spring within said housing, said second coil spring having a first end located by the housing, and a second end operatively associated with a releasable latch mechanism for securing said housing in said skiing position on said base plate, and respective adjustment means for each of said first and second coil springs for adjusting release settings thereof.

21. A safety binding in accordance with claim 20, wherein said respective adjustment means are provided at the end of the housing remote from said sole clamp means.

22. A safety binding in accordance with claim 20, wherein said adjustment means for said second coil spring comprises a first adjustable abutment nut screw-threaded into said housing and cooperating with said housing to locate the first end of said second coil spring.

23. A safety binding in accordance with claim 22, wherein said first coil spring is located within said second coil spring, and said adjustment means for said first coil spring comprises a second adjustable abutment nut screw-threaded onto said rod means.

24. A safety binding in accordance with claim 23, wherein said second adjustable abutment nut is disposed within said first abutment nut and is movable relative thereto in the axial direction of said first and second coil springs.

25. A safety binding in accordance with claim 20, wherein said adjustment means for said first coil spring comprises a second adjustable abutment nut screw-threaded onto said rod means.

26. A safety binding in accordance with claim 20, wherein said transverse axle means is provided at the end of the housing remote from said sole clamp means.

27. A safety binding in accordance with claim 20, wherein both said first and second coil springs are compression coil springs.

28. A safety binding in accordance with claim 20, wherein both said first and second coil springs are of substantially the same length.

29. A safety binding in accordance with claim 20, wherein said first end of said first coil spring is located by a transverse wall of the housing, said first coil spring being disposed on one side of said wall and said sole clamp means on the opposite side of said wall, and said rod means extending through a passage in said transverse wall.

30. A safety binding in accordance with claim 20, wherein said latch mechanism comprises latch journal means adapted to engage in latch recess means of an upward release cam track means.

31. A safety binding in accordance with claim 30, wherein said release cam track means includes an angled surface to facilitate closing the binding.

32. A safety binding according to claim 30, wherein said latch journal means is provided on pivoted link means.

33. A safety binding in accordance with claim 30, wherein said latch journal means is attached to said housing and said release cam track means is attached to said base plate.

34. A safety binding in accordance with claim 30, wherein said latch journal means is provided on link means pivotally suspended from said housing.

35. A safety binding in accordance with claim 34, wherein said second end of said second coil spring acts on said link means.

36. A safety binding in accordance with claim 35, wherein said housing includes a transverse wall, both said first and second coil springs being disposed on one side of said transverse wall, and said sole clamp means and said link means being disposed on the other side of said transverse wall, passage means in said transverse wall and means for transmitting the bias of said second spring to said link means through said passage means.

37. A safety binding in accordance with claim 36, wherein said rod means also extends through passage means in said transverse wall, said second end of said first coil spring bearing on said transverse wall.

38. A ski binding according to claim 20, wherein said sole clamp means is able to pivot sideways to either side of the housing about respective pivot noses provided one to either side of said rod means, said rod means being pivotally connected to said sole clamp means.

39. A safety binding according to claim 20, wherein both said first and said second ends of said first and second coil springs are pivotally movable with said housing about said transverse axle means.

* * * * *